US011470925B2

(12) United States Patent
Jeker et al.

(10) Patent No.: US 11,470,925 B2
(45) Date of Patent: Oct. 18, 2022

(54) TIMEPIECE WITH ATTACHED HORNS

(71) Applicant: The Swatch Group Research and Development Ltd, Marin (CH)

(72) Inventors: Daniel Jeker, Courfaivre (CH); Philipp Tschumi, Niederwil (CH); Francois Maziarz, Dompierre les Bois (FR)

(73) Assignee: The Swatch Group Research and Development Ltd, Marin (CH)

( * ) Notice: Subject to any disclaimer, the term of this patent is extended or adjusted under 35 U.S.C. 154(b) by 333 days.

(21) Appl. No.: 16/866,876

(22) Filed: May 5, 2020

(65) Prior Publication Data

US 2020/0397100 A1 Dec. 24, 2020

(30) Foreign Application Priority Data

Jun. 21, 2019 (EP) ..... 19181793

(51) Int. Cl.
*A44C 5/14* (2006.01)
*G04B 37/14* (2006.01)

(52) U.S. Cl.
CPC ..... *A44C 5/14* (2013.01); *G04B 37/1486* (2013.01)

(58) Field of Classification Search
CPC .... A44C 5/14; G04B 37/1486; G04B 37/005; G04B 37/0033; G04B 37/0041; G04B 19/286; A45F 2005/008
See application file for complete search history.

(56) References Cited

U.S. PATENT DOCUMENTS 5,392,261 A * 2/1995 Hsu ..... G04B 37/1413 368/281
5,899,370 A * 5/1999 Bould ..... A44C 5/0053 224/175

(Continued)

FOREIGN PATENT DOCUMENTS

CH 204917 A 5/1939
CH 647379 A 1/1985

(Continued)

OTHER PUBLICATIONS

Office Action dated May 28, 2021 in Chinese Application No. 202010565472.7.

(Continued)

*Primary Examiner* — Brian D Nash
(74) *Attorney, Agent, or Firm* — Sughrue Mion, PLLC

(57) ABSTRACT

A watch case (2) for wristwatches including: a middle part (4) including a side wall (10) having two sides (12A, 12B); two separate side members (6A, 6B) arranged on either side of the middle part (4), each side member (6A, 6B) extending beyond the space occupied by the middle part (4) in the longitudinal direction of the watch band and having a median portion of complementary shape to the corresponding side (12A, 12B) of the middle part (4), each side member (6A, 6B) being slidably and removably attached to the middle part (4); a bezel (8) secured to the middle part (4) on an upper face of the middle part (4); a back cover (20) fixed on a lower face of the middle part (4); characterized in that each side member (6A, 6B) is blocked in translation in the direction of sliding on the middle part (4) by the bezel (8).

25 Claims, 2 Drawing Sheets

(56) References Cited

U.S. PATENT DOCUMENTS

| | | | | |
|---|---|---|---|---|
| 5,901,117 | A * | 5/1999 | Delabre | G04B 39/006 368/309 |
| 5,943,302 | A * | 8/1999 | Fanshaw | G04B 37/0008 368/294 |
| 6,971,789 | B2 * | 12/2005 | Nakamura | G04B 37/04 368/300 |
| 8,967,437 | B2 * | 3/2015 | Wilson | G04B 37/1486 224/152 |
| 9,004,329 | B2 * | 4/2015 | Hsieh | A44C 5/00 224/221 |
| 9,483,024 | B2 * | 11/2016 | Goyet | G04B 47/046 |
| 9,612,578 | B2 * | 4/2017 | Huang | G04B 37/1486 |
| 9,737,123 | B2 * | 8/2017 | Wright | A45C 13/008 |
| 2008/0089185 | A1 * | 4/2008 | Martin | G04B 43/00 368/282 |
| 2015/0212491 | A1 * | 7/2015 | Tschumi | G04B 19/14 368/299 |
| 2015/0342308 | A1 * | 12/2015 | Wilson | A45F 5/00 224/219 |
| 2016/0223992 | A1 * | 8/2016 | Seo | A44C 5/147 |
| 2016/0242516 | A1 * | 8/2016 | Lepore | A44C 5/2071 |
| 2016/0313702 | A1 * | 10/2016 | Jufer | G04B 37/005 |
| 2017/0123377 | A1 * | 5/2017 | Tschumi | G04B 13/027 |
| 2018/0299832 | A1 * | 10/2018 | Dubois | G04B 37/22 |
| 2019/0079456 | A1 * | 3/2019 | Favre | A44C 5/14 |
| 2019/0187619 | A1 * | 6/2019 | Wahler | G04B 37/0041 |
| 2021/0088974 | A1 * | 3/2021 | Tschumi | G04B 37/08 |
| 2021/0382439 | A1 * | 12/2021 | Kim | G06F 1/163 |
| 2022/0121155 | A1 * | 4/2022 | Tschumi | G04B 37/05 |

FOREIGN PATENT DOCUMENTS

| | | | |
|---|---|---|---|
| CH | 652885 | A3 | 12/1985 |
| CN | 201188177 | Y | 1/2009 |
| CN | 206920832 | U | 1/2018 |
| CN | 208922074 | U | 5/2019 |
| DE | 10305305 | A1 | 9/2004 |
| EP | 0109997 | A1 | 6/1984 |
| EP | 0 853 141 | A2 | 7/1998 |
| EP | 1975747 | A2 | 10/2008 |
| EP | 2 431 825 | A1 | 3/2012 |
| IT | T020120648 | A1 | 10/2012 |
| JP | 63-99292 | U | 6/1988 |
| JP | 10-259487 | A | 9/1998 |
| WO | 2005/085962 | A2 | 9/2005 |

OTHER PUBLICATIONS

European Search Report for EP 19 18 1793 dated Dec. 2, 2019.
Communication dated Jun. 29, 2021 from the Japanese Patent Office in Application No. 2020-087178.
Communication dated Jul. 29, 2021 by the Korean Patent Office in Korean Application No. 10-2020-0066876.

* cited by examiner

TIMEPIECE WITH ATTACHED HORNS

CROSS REFERENCE TO RELATED APPLICATIONS

This application claims priority to European Patent Application No. 19181793.1 filed Jun. 21, 2019, the entire contents of which are incorporated herein by reference.

FIELD OF THE INVENTION

The invention concerns a watch case and more specifically a wristwatch case.

PRIOR ART

The published German Patent DE10305305 discloses a wristwatch comprising a case middle and two removable side parts arranged on either side of the case middle. Each of the side parts is delimited at the ends thereof by horns adapted to receive the two pins intended for attachment of the watch band. The side parts are held on the case middle by the two pins which rigidly connect the respective horns to the screw fixing means. This wristwatch has the drawback of not allowing the horns to be changed in an easy and non-restrictive manner to change the aesthetics of the watch case, since a tool is required to loosen the screws in order to release the side parts and change the horns.

SUMMARY OF THE INVENTION

It is an object of the invention to overcome at least one of the drawbacks of the aforementioned state of the art. More particularly, it is an object of the invention to simplify the making of a watch case. The present invention concerns a watch case for wristwatches comprising: a middle part comprising a side wall having two sides arranged on either side of a median plane extending in the longitudinal direction of the watch band; two separate side members arranged on either side of the middle part, each side member extending beyond the space occupied by the middle part in the longitudinal direction of the watch band and having a median portion of complementary shape to the corresponding side of the middle part, each side member being slidably and removably attached to the middle part; a bezel secured to the middle part on an upper face of the middle part; a back cover fixed on a lower face of the middle part; characterized in that each side member is blocked in translation in the direction of sliding on the middle part by the bezel.

According to an advantageous embodiment of the invention, one portion of a lower face of the bezel comes to rest on the upper edges of the two respective side members.

According to an advantageous embodiment of the invention, the middle part comprises a threaded collar in the upper portion of the middle part and the bezel is screwed onto the collar in order to block the side members in translation on the middle part.

According to an advantageous embodiment of the invention, each removable sliding attachment includes at least one groove formed on the wall of the middle part, said groove extending perpendicularly with respect to the back cover of said case.

According to an advantageous embodiment of the invention, the at least one groove of each removable sliding attachment comprises a pair of grooves.

According to an advantageous embodiment of the invention, the first pair and the second pair of grooves are respectively disposed on either side of the median plane.

According to an advantageous embodiment of the invention, the first pair and the second pair of grooves are disposed symmetrically on either side of the median plane.

According to an advantageous embodiment of the invention, the grooves of the first pair or of the second pair of grooves are disposed symmetrically on either side of a plane orthogonal to the median plane and to the longitudinal direction of the watch band.

According to an advantageous embodiment of the invention, the wall is annular.

According to an advantageous embodiment of the invention, a plane passing through the reference axis and through one of the grooves of the middle part forms an angle of between 10 and 45° with respect to the median plane.

According to an advantageous embodiment of the invention, each groove is closed by a stop surface.

According to an advantageous embodiment of the invention, the stop surface is arranged on the back of the case in a direction perpendicular to the back of the watch case.

According to an advantageous embodiment of the invention, the stop surface is defined by a portion of an edge of the case back.

According to an advantageous embodiment of the invention, each groove is open on an upper portion of the middle part.

According to an advantageous embodiment of the invention, each side member comprises a pair of ribs of complementary shape intended to be inserted in each corresponding groove formed in the middle part.

According to an advantageous embodiment of the invention, each side member has an elongated arc shape and the pair of ribs is formed on an internal wall of said side member, said wall being delimited on either side by the pair of ribs.

According to an advantageous embodiment of the invention, each side member comprises two slots arranged on said wall and adjacent to the two respective ribs.

According to an advantageous embodiment of the invention, the middle part comprises a shoulder encircling the threaded collar.

According to an advantageous embodiment of the invention, another portion of the lower face of the bezel rests on the shoulder.

According to an advantageous embodiment of the invention, the median portion of each of the side members ends at both ends thereof in a terminal portion forming attachment horns, each horn being adapted to receive one end of a watch band pin.

According to an advantageous embodiment of the invention, the middle part is fabricated with a first material and the two side members with a second material, the first material being identical to or different from the second.

According to an advantageous embodiment of the invention, the middle part or each side member has a coating layer.

According to an advantageous embodiment of the invention, the middle part and the side members respectively have coating layers.

According to an advantageous embodiment of the invention, the composition of the coating layer of the middle part is different from or identical to the composition of each of the coating layers of the two side members.

According to an advantageous embodiment of the invention, one of the two side members comprises a notch for the passage of a winding stem.

The invention also concerns a wristwatch comprising the watch case.

Generally, the advantageous embodiments of each subject of the invention are also applicable to the other subjects of the invention. Insofar as possible, each subject of the invention can be combined with the other subjects. The subjects of the invention can also be combined with the embodiments of the specification, which can also be combined with each other.

The measures of the invention are advantageous in that they make it possible to simplify the steps of machining the middle part, whose shape is less complex in the absence of horns. Moreover, they also make it possible to combine different materials in order to optimise the strength of the watch. Further, they make it possible to transform the wristwatch into a pocket watch by replacing the horns with elements suitable for the attachment of a chain, for example. Finally, the demarcation between the side members and the middle part is not very marked.

BRIEF DESCRIPTION OF THE FIGURES

Other features and advantages of the present invention will be better understood with the aid of the description and the drawings.

DESCRIPTION OF EMBODIMENTS

Figure 1:
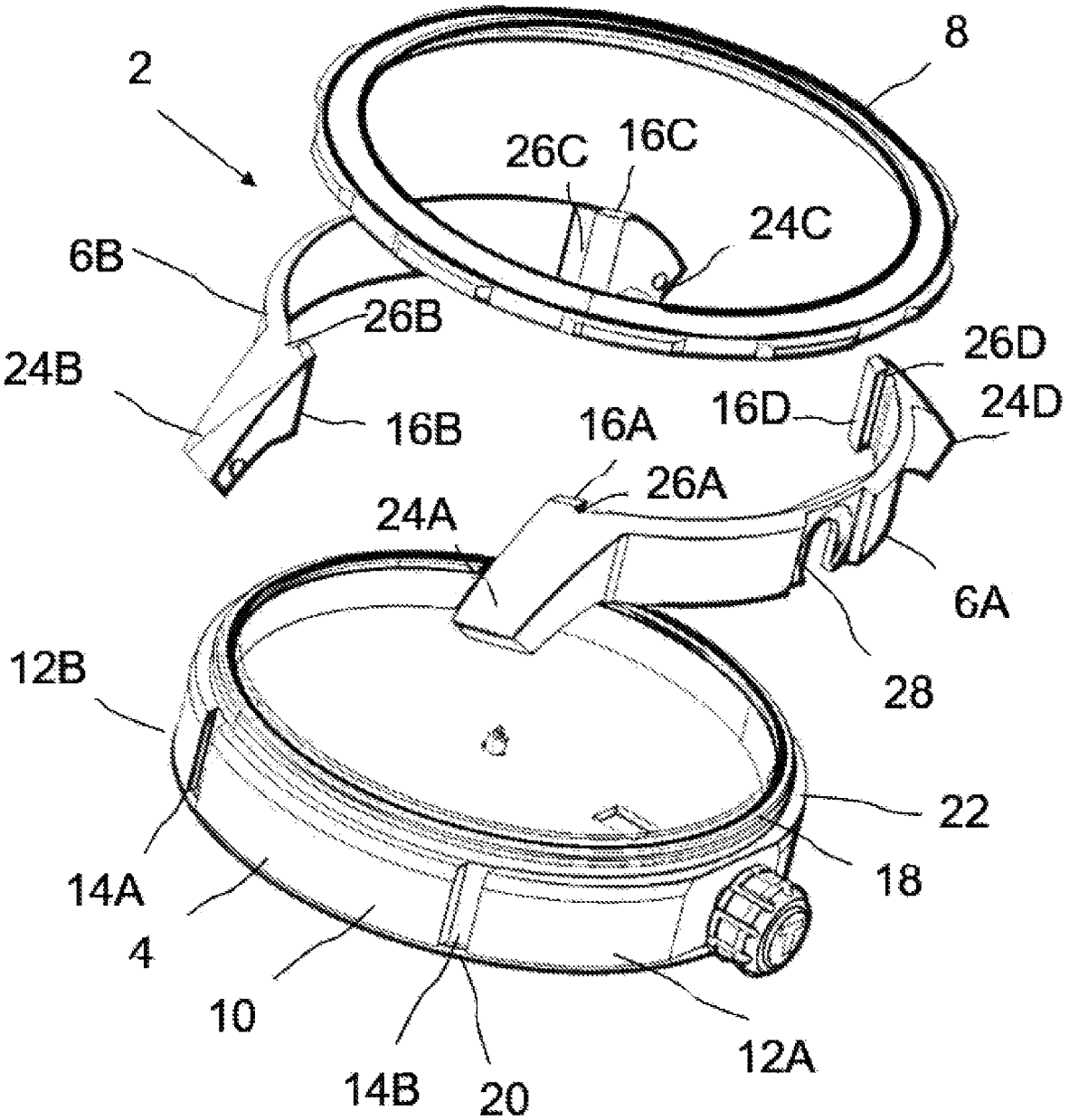
FIG. 1 represents an exploded schematic view of a watch case according to the invention.

FIG. 1 represents an exploded view of a watch case 2 according to the invention. The illustrated wristwatch case 2 comprises a middle part 4, two side members 6A, 6B and a bezel 8. Watch case 2 has a median plane (not illustrated) extending in a longitudinal direction of the watch band (not illustrated). The median plane is a plane of symmetry of middle part 4 of (substantially) cylindrical shape having a so-called reference axis, this axis being included in the median plane. Middle part 4 comprises a side wall 10 having two sides 12A, 12B arranged on either side of the median plane. In FIG. 1, sides 12A, 12B are in the shape of an arc of a cylinder.

The two side members 6A, 6B are devised to be attached either side of middle part 4. Side members 6A, 6B extend beyond the space occupied by middle part 4 in the longitudinal direction of the watch band when these latter are mounted on middle part 4 (see FIG. 2). Each side member 6A, 6B has a median portion of complementary shape to the corresponding side of middle part 4. Each side member 6A, 6B is slidably and removably attached to middle part 4. Each side member 6A, 6B is blocked in translation in the direction of sliding on middle part 4 by bezel 8. The removable sliding attachment can comprise two pairs of grooves 14A, 14B formed on wall 10 of middle part 4. The first pair and the second pair of grooves 14A, 14B can be arranged symmetrically on either side of the median plane. Further, grooves 14A, 14B of one of the two pairs can be symmetrically arranged on either side of a plane orthogonal to the median plane and to the longitudinal direction of the watch band. Each groove 14A, 14B can be arranged such that a plane passing through the reference axis and the groove 14A, 14B in question forms an angle of between 10 and 45° with respect to the median plane. Each groove 14A, 14B can be open on an upper portion (for example on an upper face of middle part 4) of middle part 4. The two side members 6A, 6B can each comprise a pair of ribs 16A, 16B, 16C, 16D intended to be inserted in each corresponding groove 14A, 14B formed in middle part 4. The two side members 6A, 6B can each have an elongated arc shape and/or ribs 16A, 16B, 16C, 16D can be formed at the ends of the side members.

Bezel 8 is intended to be secured to middle part 4. To this end, bezel 8 can be screwed onto a collar 18 formed on the upper portion of middle part 4. In this configuration, collar 18 has a thread intended to engage with a corresponding thread formed on an inner face of bezel 8.

Watch case 2 also comprises a back cover 20 attached to a lower face of middle part 4. The stop surface associated with each of grooves 14A, 14B can be defined by a corresponding portion on the edge of back cover 20. Advantageously, each groove 14A, 14B can extend perpendicularly with respect to the back of case 2. Each groove 14A, 14B on back cover 20 of case 2 can be closed.

Side members 6A, 6B are retained by bezel 8, such that one portion of the lower face of bezel 8 rests on upper edges of the two respective side members 6A, 6B. Middle part 4 can comprise a shoulder 22 encircling threaded collar 18. Another portion of the lower face of bezel 8 is also arranged to be able to rest on shoulder 22.

Each side member 6A, 6B can have at both ends thereof horns 24A, 24B, 24C, 24 for attachment of a watch band, each horn being adapted to receive one end of a watch band attachment pin. Each side member 6A, 6B can comprise two slots 26A, 26B, 26C, 26D arranged adjacent to the two respective ribs 16A, 16B, 16C, 16D on an inner side wall of each side member 6A, 6B, the inner side wall connecting the two ribs 16A, 16B, 16C, 16D.

Further, middle part 4 can be fabricated with a first material and the two side members 6A, 6B with a second material, the first material preferably being different from the second. Alternatively, for certain applications, the materials selected for middle part 4 and side members 6A, 6B can be the same. The first and/or second material can be stainless steel (generally 316L steel), gold, platinum, titanium, brass, ceramic, plastic, carbon, wood, silver, another metal, a metal alloy, or any combination of the latter.

Advantageously, middle part 4 and side members 6A, 6B can respectively (at least) have coating layers. When middle part 4 and side members 6A, 6B respectively have coating layers whose composition is identical, the material of middle part 4 can be different from that of the material of the two side members 6A, 6B in order to optimise manufacturing costs and/or to optimise the strength of watch case 2. Each layer can be a metal layer, a varnish or a pigmented layer, or any combination of the latter.

Further, one of the two side members 6A, 6B can comprise a notch 28 for the passage of a winding stem.

Figure 2:
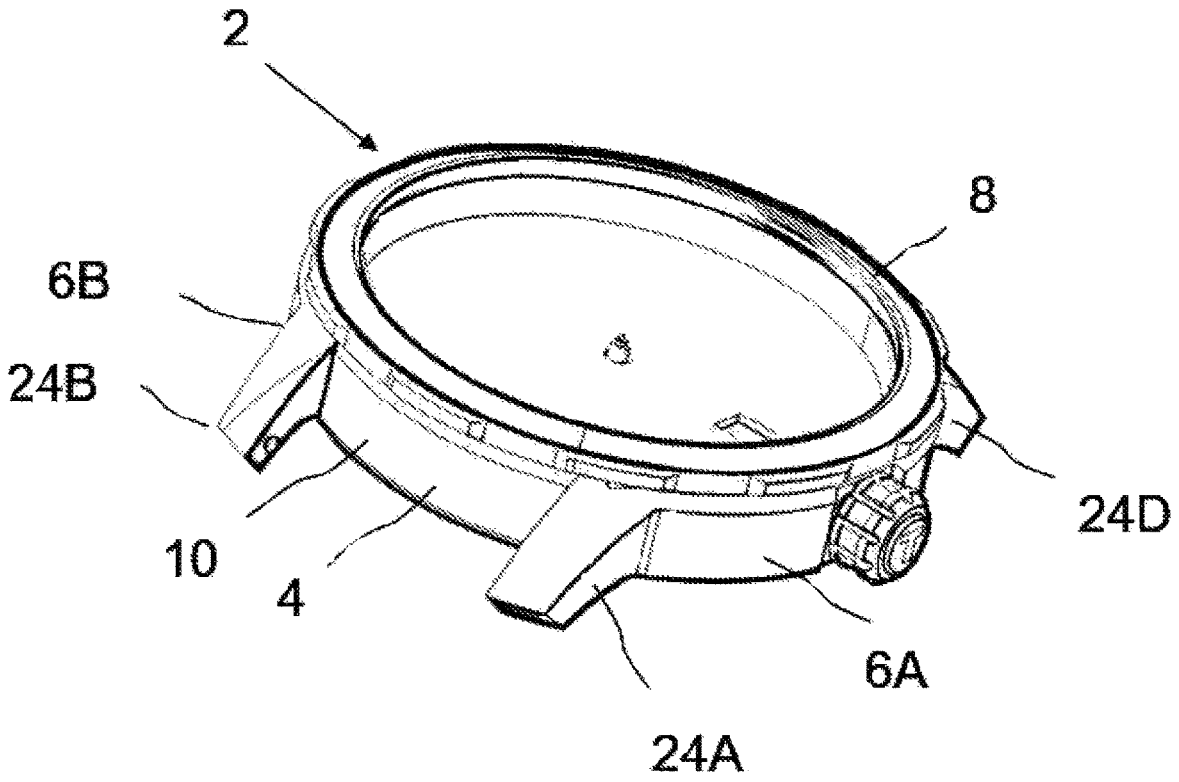
FIG. 2 illustrates a schematic view of a watch case assembled according to the invention.

FIG. 2 represents a schematic view of watch case 2 assembled according to the invention.

The invention also concerns a wristwatch comprising a watch case 2 having the features of the watch case 2 presented above.

Although a particular embodiment has just been described in detail, those skilled in the art will appreciate that various modifications and alternatives thereto can be envisaged in light of the overall teaching provided by the present description. In particular, the bezel could be attached by means other than by screwing the actual bezel to the middle part, for example by snap fit, clips or by screw means with the aid of screws or similar. Consequently, the specific arrangements described herein are intended to be given purely by way of illustration, with no intention of limiting the scope of the invention.

The invention claimed is:

1. A watch case (2) for wristwatches comprising:

a middle part (4) comprising an annular wall (10) having two sides (12A, 12B) arranged on either side of a median plane extending in a longitudinal direction of a watch band;

two side members (6A, 6B) arranged on either side of the middle part (4), each side member (6A, 6B) having opposing end portions extending beyond the space occupied by the middle part (4) in the longitudinal direction of the watch band and having a median portion of complementary shape to the corresponding side (12A, 12B) of the middle part (4) which is continuous with the opposing end portions, each side member (6A, 6B) being slidably and removably attached to the middle part (4);

a bezel (8) secured to the middle part (4) on an upper face of the middle part (4); and a back cover (20) attached to a lower face of the middle part (4);

wherein each side member (6A, 6B) is blocked in translation in the direction of sliding on the middle part (4) by the bezel (8).

2. The watch case (2) according to claim 1, wherein one portion of a lower face of the bezel (8) rests on upper edges of the two respective side members (6A, 6B).

3. The watch case (2) according to claim 1, wherein the middle part (4) comprises a threaded collar (18) in the upper portion of the middle part (4) and in that the bezel is screwed onto the threaded collar in order to block the side members (6A, 6B) in translation on the middle part (4).

4. The watch case (2) according to claim 3, wherein the middle part (4) comprises a shoulder (22) encircling the threaded collar (18).

5. The watch case (2) according to claim 1, wherein each removable sliding attachment comprises at least one groove (14A, 14B) formed on the annular wall (10) of the middle part (4), said groove (14A, 14B) extending perpendicularly with respect to the back cover (20) of said case (2).

6. The watch case (2) according to claim 5, wherein the at least one groove (14A, 14B) of each removable sliding attachment comprises a pair of grooves (14A, 14B).

7. The watch case (2) according to claim 6, wherein the first pair and the second pair of grooves (14A, 14B) are respectively arranged on either side of the median plane.

8. The watch case (2) according to claim 7, wherein the first pair and the second pair of grooves (14A, 14B) are arranged symmetrically on either side of the median plane.

9. The watch case (2) according to claim 6, wherein the grooves (14A, 14B) of the first pair or of the second pair of grooves are arranged symmetrically on either side of a plane orthogonal to the median plane and to the longitudinal direction of the watch band.

10. The watch case (2) according to claim 5, wherein the annular wall (10) has a cylindrical shape having a reference axis.

11. The watch case (2) according to claim 5, wherein a plane passing through the reference axis and through one of the grooves (14A, 14B) of the middle part (4) forms an angle of between 10 and 45° with respect to the median plane.

12. The watch case (2) according to claim 5, wherein each groove (14A, 14B) is closed by a stop surface.

13. The watch case (2) according to claim 12, wherein the stop surface is arranged on the back (20) of the case (2) and extends in a circumferential direction of the watch case.

14. The watch case (2) according to claim 13, wherein the stop surface is defined by one portion of an edge of the back cover (20).

15. The watch case (2) according to claim 5, wherein each groove (14A, 14B) is open on an upper portion of the middle part.

16. The watch case (2) according to claim 5, wherein each side member (6A, 6B) comprises a pair of ribs (16A, 16B, 16C, 16D) of complementary shape intended to be inserted into each corresponding groove (14A, 14B) formed in the middle part (4).

17. The watch case (2) according to claim 16, wherein each side member (6A, 6B) has an elongated arc shape and the pair of ribs (16A, 16B, 16C, 16D) is formed on an inner surface of said side member, said wall being delimited on either side by each rib of the pair of ribs (16A, 16B, 16C, 16D).

18. The watch case (2) according to claim 17, wherein each side member (6A, 6B) comprises two slots (26A, 26B, 26C, 26D) arranged on said wall and adjacent to the two respective ribs (16A, 16B, 16C, 16D).

19. The watch case (2) according to claim 1, wherein the median portion of each of the side members (6A, 6B) ends at both ends thereof in a terminal portion forming attachment horns (24A, 24B, 24C, 24D), each horn being adapted to receive one end of a watch band pin.

20. The watch case (2) according to claim 1, wherein the middle part (4) is fabricated with a first material and the two side members (6A, 6B) with a second material, the first material being identical to or different from the second.

21. The watch case (2) according to claim 1, wherein the middle part (4) or each side member (6A, 6B) has a coating layer.

22. The watch case (2) according to claim 1, wherein the case middle (4) and the side members (6A, 6B), respectively, have coating layers.

23. The watch case (2) according to claim 22, wherein the composition of the coating layer of the middle part (4) is different from or identical to the composition of each of the coating layers of the two side members (6A, 6B).

24. The watch case (2) according to claim 23, wherein one of the two side members (6A, 6B) can comprise a notch (28) for the passage of a winding stem.

25. A wristwatch case comprising a watch case (2), wherein the watch case (2) comprises:

a middle part (4) comprising a side wall (10) having two sides (12A, 12B) arranged on either side of a median plane extending in a longitudinal direction of a watch band;

two side members (6A, 6B) arranged on either side of the middle part (4), each side member (6A, 6B) having opposing end portions extending beyond the space occupied by the middle part (4) in the longitudinal direction of the watch band and having a median portion of complementary shape to the corresponding side (12A, 12B) of the middle part (4) which is continuous with the opposing end portions, each side member (6A, 6B) being slidably and removably attached to the middle part (4);

a bezel (8) secured to the middle part (4) on an upper face of the middle part (4);

a back cover (20) attached to a lower face of the middle part (4);

wherein each side member (6A, 6B) is blocked in translation in the direction of sliding on the middle part (4) by the bezel (8).

* * * * *